US008333596B2

(12) United States Patent
Kang et al.

(10) Patent No.: US 8,333,596 B2
(45) Date of Patent: Dec. 18, 2012

(54) CONNECTOR HAVING A TAIL WITH VERTICAL PANELS INSERTED INTO A DIELECTRIC HOLDING A CONTACT TERMINAL SURROUNDED BY A BODY

(75) Inventors: Kyoung il Kang, Gyeonggi-do (KR); Yong Goo Lee, Seoul (KR); Jang Mook Lee, Chungcheongnam-do (KR); Nam Sik Lee, Gyeonggi-do (KR)

(73) Assignee: Gigalane Co., Ltd., Gyeonggi-Do (KR)

( * ) Notice: Subject to any disclaimer, the term of this patent is extended or adjusted under 35 U.S.C. 154(b) by 0 days.

(21) Appl. No.: 13/256,582

(22) PCT Filed: Dec. 10, 2009

(86) PCT No.: PCT/KR2009/007375

§ 371 (c)(1),
(2), (4) Date: Sep. 14, 2011

(87) PCT Pub. No.: WO2010/107171

PCT Pub. Date: Sep. 23, 2010

(65) Prior Publication Data

US 2012/0009812 A1 Jan. 12, 2012

(30) Foreign Application Priority Data

Mar. 16, 2009 (KR) ..... 10-2009-0021991

(51) Int. Cl.
*H01R 1/00* (2006.01)

(52) U.S. Cl. ..... 439/63

(58) Field of Classification Search ..... 439/63, 439/74, 83, 581, 582, 752
See application file for complete search history.

(56) References Cited

U.S. PATENT DOCUMENTS

| | | | | |
|---|---|---|---|---|
| 6,533,610 | B1 * | 3/2003 | Dai et al. | 439/581 |
| 6,648,653 | B2 * | 11/2003 | Huang et al. | 439/63 |
| 7,118,383 | B2 * | 10/2006 | Nagata et al. | 439/63 |
| 7,445,458 | B1 * | 11/2008 | Yamane | 439/63 |
| 7,648,397 | B2 * | 1/2010 | Shimizu | 439/620.21 |
| 2001/0027033 | A1 * | 10/2001 | Fujimoto et al. | 439/63 |
| 2004/0102061 | A1 * | 5/2004 | Watanabe | 439/63 |
| 2004/0137764 | A1 | 7/2004 | Yamane | 439/63 |
| 2006/0024985 | A1 | 2/2006 | Nagata et al. | 439/63 |
| 2006/0141811 | A1 * | 6/2006 | Shichida et al. | 439/63 |
| 2008/0268705 | A1 | 10/2008 | Yamane | 439/578 |
| 2010/0248503 | A1 * | 9/2010 | Kang et al. | 439/63 |

FOREIGN PATENT DOCUMENTS

KR 10-2006-0046761 5/2006

OTHER PUBLICATIONS

International Search Report (ISR) in PCT/KR2009/007375 dated Jul. 2, 2010.

* cited by examiner

*Primary Examiner* — Chandrika Prasad
(74) *Attorney, Agent, or Firm* — Harness, Dickey & Pierce, P.L.C.; Anthony G. Fussner; Kisuk Lee

(57) ABSTRACT

There is provided a micro connector mounted on a printed circuit board (PCB) comprising a core conductor including a contact terminal formed of two or more insertion panels and a signal transmission panel; a body including a trunk formed in the shape of a barrel surrounding the contact terminal, and one or more projection arms extended from a bottom of the trunk; a dielectric; and a tail including a bottom panel disposed opposite to the signal transmission panel, interposing the body therebetween, and supporting the dielectric.

11 Claims, 9 Drawing Sheets

CONNECTOR HAVING A TAIL WITH VERTICAL PANELS INSERTED INTO A DIELECTRIC HOLDING A CONTACT TERMINAL SURROUNDED BY A BODY

CROSS-REFERENCE TO RELATED APPLICATIONS

This application is a national phase application of PCT Application No. PCT/KR2009/007375, filed on Dec. 10, 2009, which claims the benefit and priority to Korean Patent Application No. 10-2009-0021991, filed Mar. 16, 2009. The entire disclosures of the applications identified in this paragraph are incorporated herein by references.

TECHNICAL FIELD

The present invention relates to a connector, and more particularly, to a micro connector mounted on a printed circuit board (PCB), the connector capable of increasing assembling performance by manufacturing elements thereof, respectively, and coupling the elements, thereby increasing a production yield.

BACKGROUND ART

Various signals are transmitted among wired or wireless communication devices. Wired or wireless communication devices where signals are transmitted are electrically connected to one another. As a general connection method, there is a method of using a connector, which is connected to a coaxial cable or a printed circuit board (PCB) and connected to a corresponding plug or other connection means. For example, to efficiently transmit and receive wireless signals, an antenna may be attached to a wireless communication device. In this case, generally, a male connector is installed in the antenna and a female connector is installed in the wireless communication device. Of course, an opposite situation is also possible. Generally, a connector includes a body with which a plug is coupled and a core conductor disposed in the body to transmit a signal. The body and the core conductor are coupled with each other by a dielectric. The core conductor is disposed inside the body and a circular core, a mold, is inserted into the center of the body. A mold forming the dielectric for coupling the body with the core conductor is disposed in a bottom of the body, and the body, the core conductor, and the dielectric are coupled with one another by insert molding. Then, the mold is separated. As described above, the body and the core conductor are disposed and a mold is inserted, thereby forming one connector. Accordingly, it is very difficult to automate a process of manufacturing a connector at one time by using several core conductors and bodies, and then, productivity is decreased. Also, since scratches frequently occur on an outer surface of a core due to an inner side surface of a body while removing the core inserted into the body, it is required to frequently change the core and manufacturing costs are increased. Accordingly, it is required to increase productivity without causing scratches on a core while manufacturing connectors.

DISCLOSURE OF INVENTION

Technical Problem

The present invention provides a micro connector mounted on a printed circuit board (PCB), the connector capable of manufacturing elements, respectively, to be well assembled, thereby increasing productivity.

Solution to Problem

According to an aspect of the present invention, there is provided a connector. The connector includes a core conductor, a body, a dielectric, and a tail. The core conductor is formed of a single body including a contact terminal formed of two or more insertion panels forming an insertion space into which a signal pin is inserted and a signal transmission panel connected to a bottom of the contact terminal and electrically connected to an external signal line. The body is formed of a single body including a trunk formed in the shape of a barrel surrounding the contact terminal, the trunk including an incision part electrically insulated from the core conductor and expanding and contracting while coupling with a plug, and one or more projection arms extended from a bottom of the trunk. The dielectric holds the contact terminal and the bottom of the trunk of the body or more. The tail is formed of a single body including a bottom panel disposed opposite to the signal transmission panel, interposing the body therebetween, and supporting the dielectric, the bottom panel on which a bottom of the dielectric is put, and one or more vertical panels formed vertical to the bottom panel and inserted into the dielectric in such a way that the bottom panel is not separated from the dielectric. In the case of the core conductor, a vertical part inserted into the dielectric in such a way that the contact terminal held by the dielectric is not easily separated is formed on the signal transmission panel in a single body to be vertical to the signal transmission panel. In the case of the body, a fastening groove preventing separation of the plug after coupling is further formed around an upper circumference of the trunk, one or more fastening projections preventing the separation of the plug are formed along an inner circumference of the trunk, and one or more coupling support grooves are formed on a top of the body. Two projection arms are extended from both ends of the bottom of the trunk, which are parallel to each other. While the projection arms and the bottom of the trunk are held by the dielectric, the projection arms pass through the dielectric, are projected from a bottom surface of the dielectric and are bent toward both sides of the dielectric in such a way that the trunk is not easily separated from the dielectric. In the case of the tail, the bottom panel is in the shape of ⊏, the vertical panel is formed in the center of the bottom surface to be vertical thereto, and a tail fastening part is formed on a side of the vertical panel in such a way that the vertical panel is not easily separated from the dielectric. The tail fastening part may be a groove formed on the side of the vertical panel. The tail fastening part may be in the shape of a beam connecting the one or more vertical panels with one another. The tail fastening part may be a hole formed on the vertical panel. The core conductor, the body, the dielectric, and the tail are manufactured, separately, and assembled. The core conductor and the tail are coupled with the dielectric by insert molding and the body is inserted into the dielectric. The dielectric includes a body holding part formed of a tetrahedral mold including a ring-shaped insertion hole into which the bottom of the trunk is inserted and held in a center thereof and a projection arm guide hole, into which the projection arm is inserted, formed on both sides of the ring-shaped hole and insertion panel holes, into which the insertion panel is inserted, are formed on the center of the ring-shaped hole. On the bottom surface of the dielectric, there are formed a projection arm location part where the projection arm projected via the projection arm guide hole is bent and in contact with, a signal transmission panel location part where the signal transmission panel connected to the insertion panels inserted into the insertion panel holes is in contact with, a bottom panel location part where the bottom panel is in contact with, and vertical panel holes into which the vertical panel is inserted.

ADVANTAGEOUS EFFECTS OF INVENTION

As described above, a connector according to an embodiment of the present invention is produced by manufacturing and assembling respective elements, thereby preventing a decrease of productivity of connectors, due to manufacturing costs or time for general molds and scratches occurring while extracting a mold from a body and increasing productivity by automating assembly. Also, since a body is separately manufactured, a shape of the body, such as a size of a groove, a depth, and a size of embossments, is adjusted to control power of coupling with a plug and structural performance. Also, the connector may be manufactured by coupling a core conductor and a tail with a dielectric by insert molding and inserting body into the dielectric. In this case, a mold inserted into the body is not required, thereby solving scratches of the mold. Also, it is easy to variously control a configuration of the body and productivity of connectors may be increased.

BEST MODE FOR CARRYING OUT THE INVENTION

Figure 1:
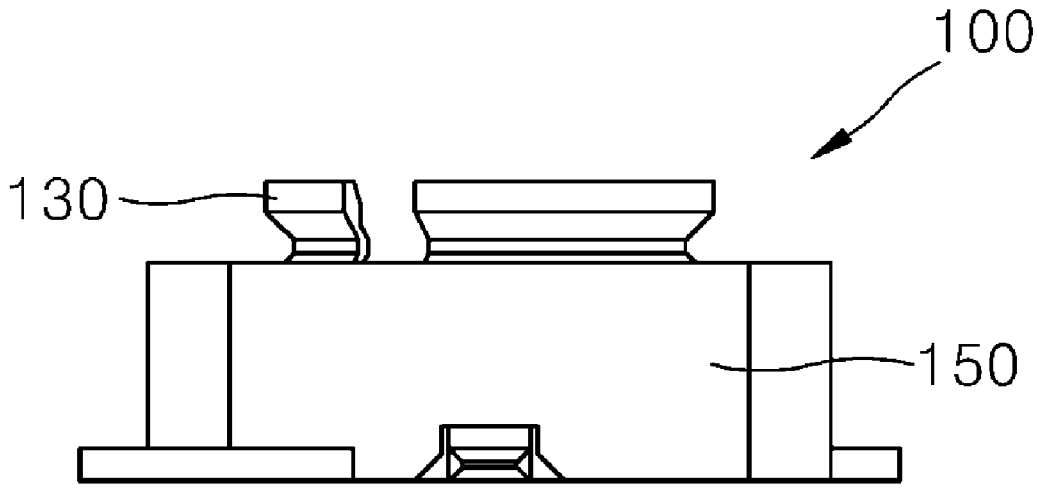
FIG. 1 is a front view illustrating a connector according to an embodiment of the present invention.

To fully understand advantages of operations of the present invention and the objects obtained by embodiments of the present invention, it is required to refer to attached drawings illustrating preferable embodiments of the present invention and contents shown in the drawings. Hereinafter, the preferable embodiments of the present invention will be described in detail with reference to the attached drawings. The same reference numerals shown in each drawing indicate the same elements.

Figure 2:
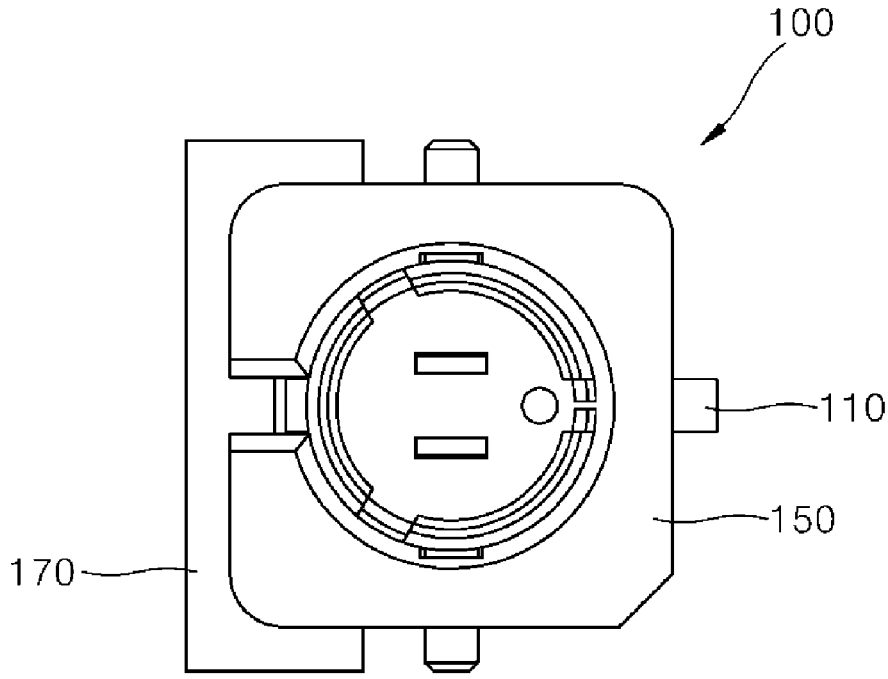
FIG. 2 is a top view illustrating the connector of FIG. 1.
Figure 3:
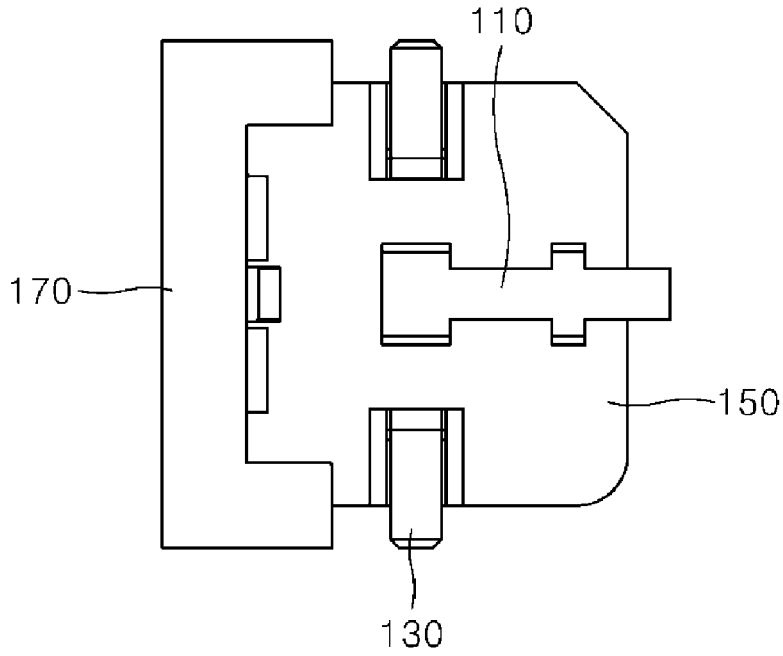
FIG. 3 is a rear view illustrating the connector of FIG. 1.

FIG. 1 is a front view illustrating a connector 100 according to an embodiment of the present invention. FIG. 2 is a top view illustrating the connector 100. FIG. 3 is a rear view illustrating the connector 100. Referring to FIGS. 1 to FIG. 3, the connector 100 includes a core conductor 110, a body 130, a dielectric 150, and a tail 170. Different from conventional methods of manufacturing connectors, in the case of the connector 100, the core conductor 110, the body 130, the dielectric 150, and the tail 170 are separately manufactured, respectively. Then, respective elements are assembled to form one complete connector 100.

Accordingly, when a connector is formed by separately assembling respective elements as described above, since it is not necessary to use a process requiring a mold while insert molding to couple a body with a core conductor as in conventional methods, it is possible to reduce costs and time for manufacturing molds and to prevent a decrease of productivity of connectors due to scratches of the mold, which occur while extracting a mold from a body.

Also, the connector 100 may be formed by coupling the core conductor 110 and the tail 170 with the dielectric 150 by insert molding and inserting the body 130 into the dielectric 150. In this case, since the dielectric 150 is formed by coupling the tail 170 with the core conductor 110 by insert molding and the body 130 is inserted into the dielectric 150 to be coupled with each other, it is not necessary to use a mold inserted into the body 130, thereby solving scratches on the mold, easily adjusting a configuration of the body 130, and increasing productivity of the connector 100.

A configuration and a coupling method of the connector 100 will be described with reference to FIGS. 4 to 14.

Figure 4:
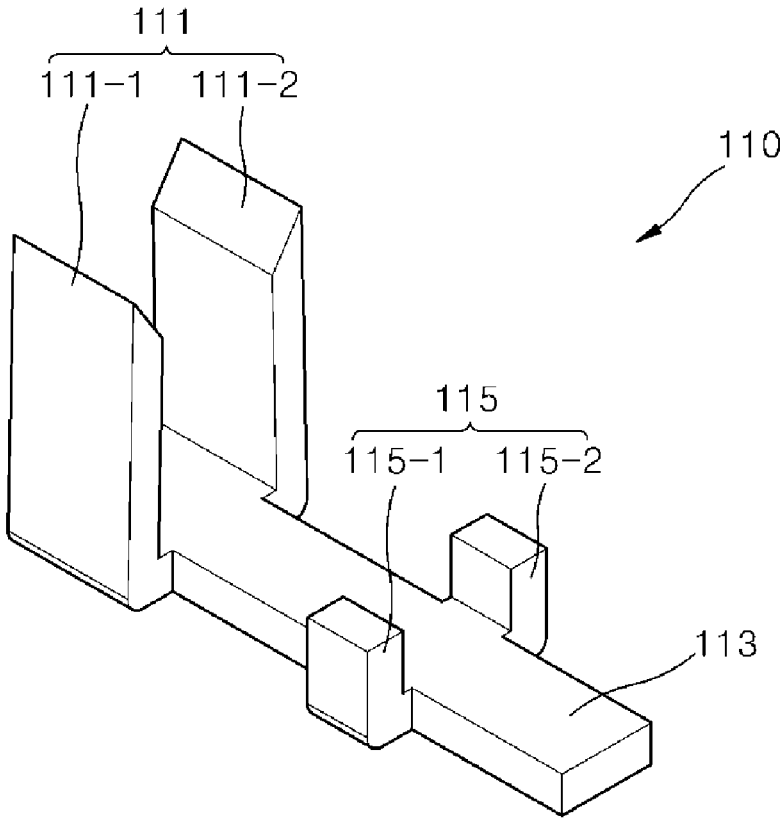
FIG. 4 is a configuration view illustrating a core conductor of the connector of FIG. 1.

FIG. 4 is a configuration view illustrating the core conductor 110. Referring to FIG. 4, the core conductor 110 is formed of a single body including a contact terminal 111 including two or more insertion panels 111-1 and 111-2 forming an insertion space into which a signal pin is inserted and a signal transmission panel 113 connected to a bottom of the contact terminal 111 and electrically connected to an external signal line. The signal transmission pane 1 113 is connected to the bottom of the contact terminal 111 and one side thereof is extended long. However, the shape of the signal transmission panel 113 is not limited to being shown in FIG. 4 but may be various. In the case of the core conductor 110, a vertical part 115 inserted into the dielectric 150 in such a way that the contact terminal 111 held by the dielectric 150 is not easily separated from the dielectric 150 is formed in a single body with the signal transmission panel 113 to be vertical thereto. As shown in FIG. 4, two vertical parts 115-1 and 115-2 may be formed on both sides of the signal transmission panel 113. However, the number of vertical parts may be one or three or more.

The insertion panels 111-1 and 111-2 of the contact terminal 111 form the insertion space and a signal pin (not shown) of a plug is inserted into the insertion space, thereby electrically connecting the signal pin to the core conductor 110 and transmitting a signal.

Also, to definitely perform an electrical connection between the signal pin and the core conductor 110, the insertion panels 111-1 and 111-2 may be formed to lean to a direction of the insertion space.

Figure 5:
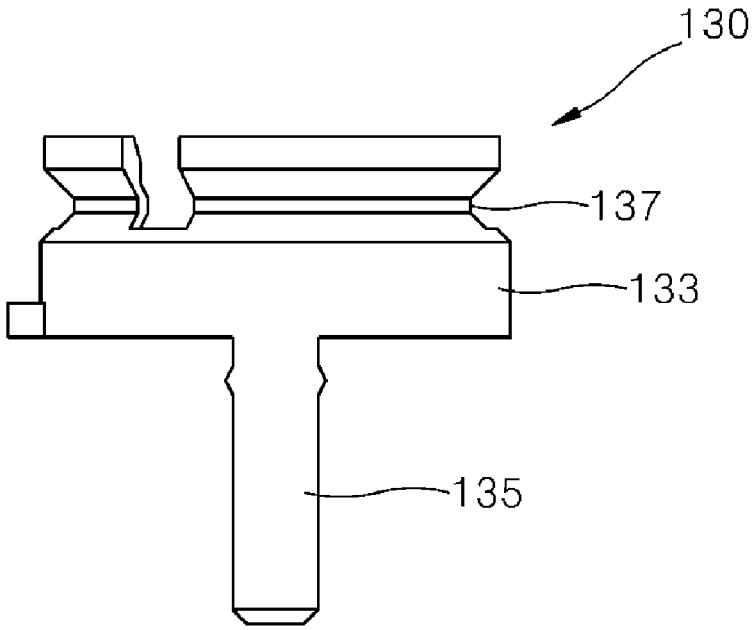
FIG. 5 is a front view illustrating a body shown in FIG. 1.
Figure 6:
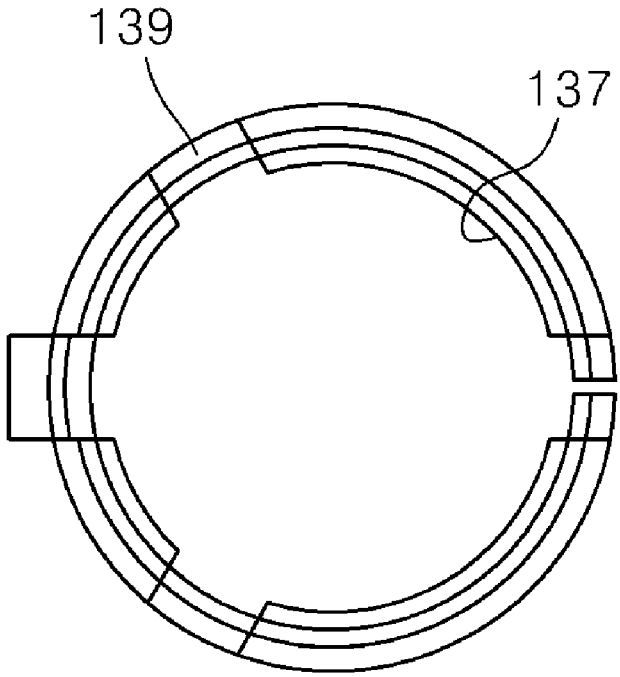
FIG. 6 is a top view illustrating the body of FIG. 5.
Figure 7:
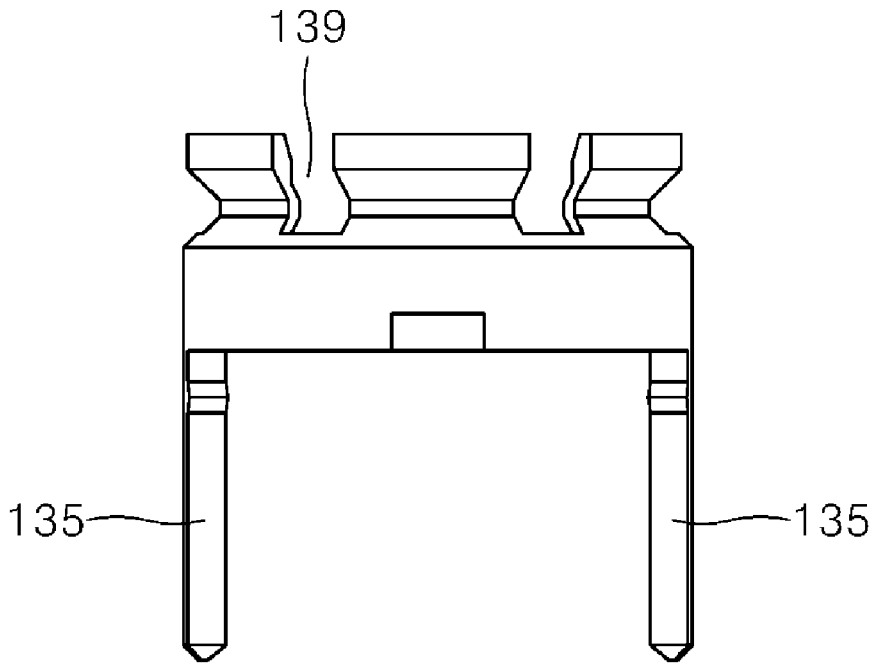
FIG. 7 is a left side view illustrating the body of FIG. 5.
Figure 8:
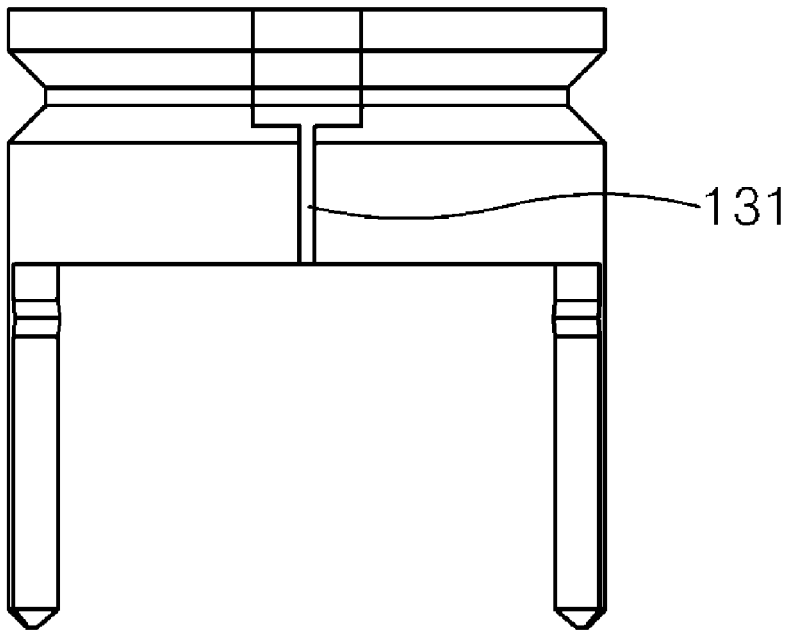
FIG. 8 is a right side view illustrating the body of FIG. 5.

FIG. 5 is a front view illustrating the body 130. FIG. 6 is a top view illustrating the body 130. FIG. 7 is a left side view illustrating the body 130. FIG. 8 is a right side view illustrating the body 130. Referring to FIGS. 5 to 8, the body 130 is a formed of a single body including a trunk 133 formed in the shape of a barrel surrounding the contact terminal 111 and including an incision part 131 electrically insulated from the core conductor 110 and expanding and contracting while coupling with the plug and one or more projection arms 135 extended from a bottom of the trunk 133. The incision part 131 allows coupling between the body 130 and the plug to be easy by becoming wider while coupling the trunk 133 with the plug. In the case of the body 130, a fastening groove 137 preventing separation of the plug after coupling may be further formed along an upper circumference of the trunk 133.

The fastening groove 137 is formed along the upper circumference of the trunk 133 in such a way that the plug is not easily separated from the trunk 133 after coupling. Since the fastening groove 137 is formed to be projected toward an inner space of the trunk 133 along the circumference thereof, that is, an outer surface of the trunk 133 becomes hollow toward the inner space and an inner surface of the trunk 133 is projected toward the inner space, a groove (not shown) formed on a trunk of the plug is fastened to a projection of the inner surface, formed by the fastening groove 137, thereby preventing the separation of the plug. One or more fastening projections (not shown) may be formed along an inner circumference of the trunk 133 to prevent the separation of the plug.

That is, as another example for preventing the separation of the plug, instead of the fastening groove 137, one or more projections may be formed on the inner circumference of the trunk 133 and projected toward the inner space of the trunk 133. Accordingly, the fastening projections are fastened to the groove formed on the trunk of the plug, thereby preventing the separation of the plug.

One or more coupling support grooves 139 are formed on a top of the body 130.

The coupling support grooves 139 allow the top of the trunk 133 of the body 130 to become open a little while coupling the trunk of the plug with the trunk 133 of the 130, thereby easily attaching and detaching the plug. Different from conventional methods, instead of insert molding a body and a core conductor at one time, since the body 130 is separately manufactured and coupled with other elements, there is much room for adjusting the shape of the body 130 according to a size and a shape of a corresponding plug. Also, it is possible to solve scratches of a mold, a core, due to the fastening groove 137 or the fastening projections.

One or more projection arms 135 extended from the bottom of the trunk 133 are formed in a single body on the body 130. Two projection arms 135 are extended from both sides of an end of the bottom of the trunk 133 to be parallel to each other. The projection arms 135 and the bottom of the trunk 133 are held by the dielectric 150. The projection arms 135 pass through the dielectric 150, are projected toward the outside of a bottom surface of the dielectric 150 and are bent toward both sides of the dielectric 150 in such a way that the trunk 133 is not easily separated from the dielectric 150. Also, the projection arms 135 are bent toward the both sides from the bottom surface of the dielectric 150 and are in contact with the bottom surface of the dielectric 150 to be close thereto. A part of an end thereof is projected toward the outside of the dielectric 150. A projected part functions as a ground.

Figure 9:
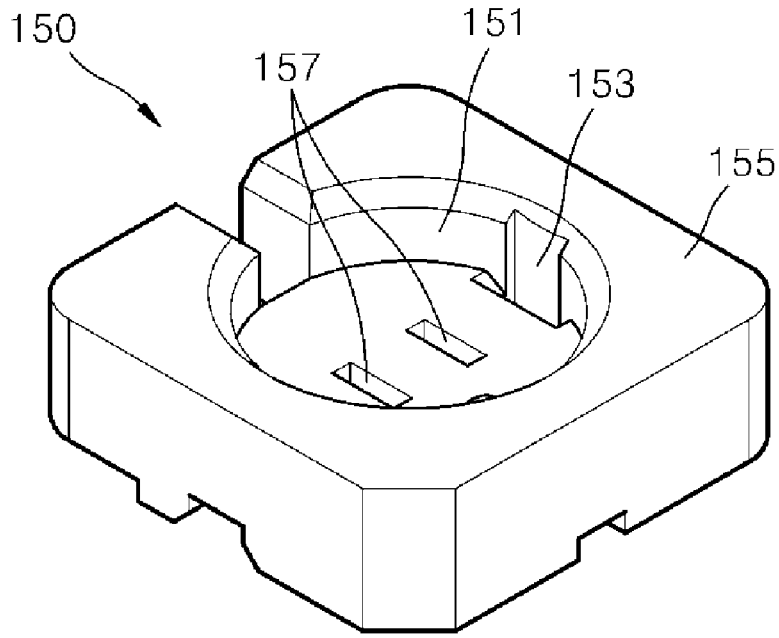
FIG. 9 is a perspective view illustrating a dielectric shown in FIG. 1.
Figure 10:
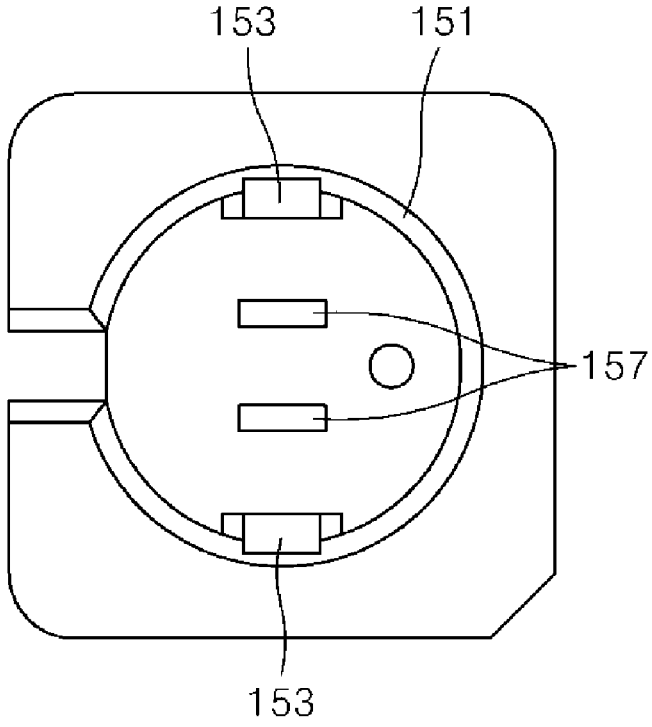
FIG. 10 is a top view illustrating the dielectric of FIG. 9.
Figure 11:
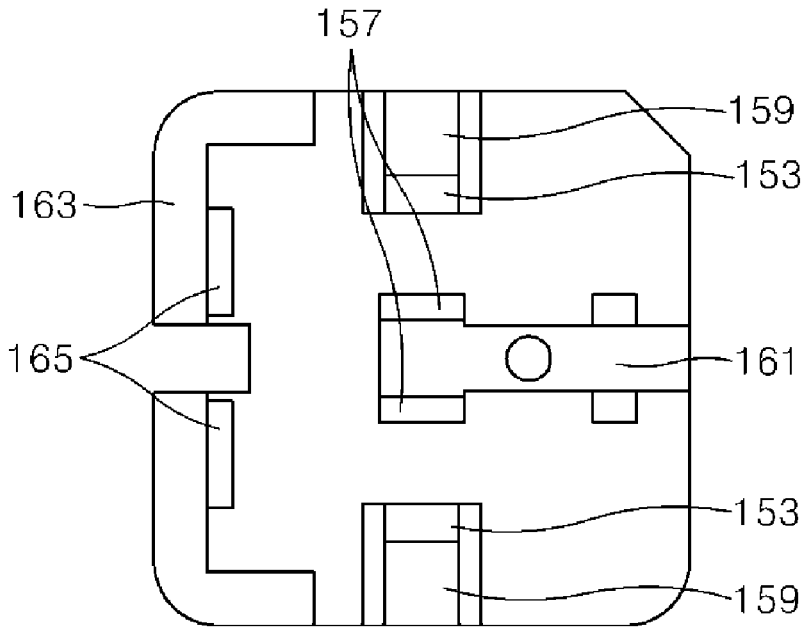
FIG. 11 is a rear view illustrating the dielectric of FIG. 9.

FIG. 9 is a perspective view illustrating the dielectric 150. FIG. 10 is a top view illustrating the dielectric 150. FIG. 11 is a rear view illustrating the dielectric 150. Referring to FIGS. 9 to 11, the dielectric 150 holds the contact terminal 111 and the bottom or more of the trunk 133 of the body.

The dielectric 150 includes a body holding part 155 formed of a tetrahedral mold including a ring-shaped insertion hole 151 holding the bottom of the trunk 133 in a center thereof and a projection arm guide hole 153, into which the projection arm 135 is inserted, formed on both sides of the ring-shaped insertion hole 151.

Insertion panel holes 157, into which the insertion panel 111 is inserted, are formed in the center of the ring-shaped insertion hole 151. On the bottom surface of the dielectric 150, there are formed a projection arm location part 159 where the projection arm 135 projected via the projection arm guide hole 153 is bent and in contact with, a signal transmission panel location part 161 where the signal transmission panel 113 connected to the insertion panels 111-1 and 111-2 inserted into the insertion panel holes 157 is in contact with, a bottom panel location part 163 where a bottom panel 171 of the tail 170 is in contact with, and vertical panel holes 165, into which a vertical panel 173 of the tail 170 is inserted.

The dielectric 150 having a configuration as described above may be separately manufactured using a mold and be coupled with other elements such as the core conductor 110, the tail 170, and the body 130. Also, the core conductor 110 and the tail 170 are arranged and the dielectric 150 is formed using a mold by insert molding, thereby coupling the core conductor 110 with the tail 170.

Figure 12:
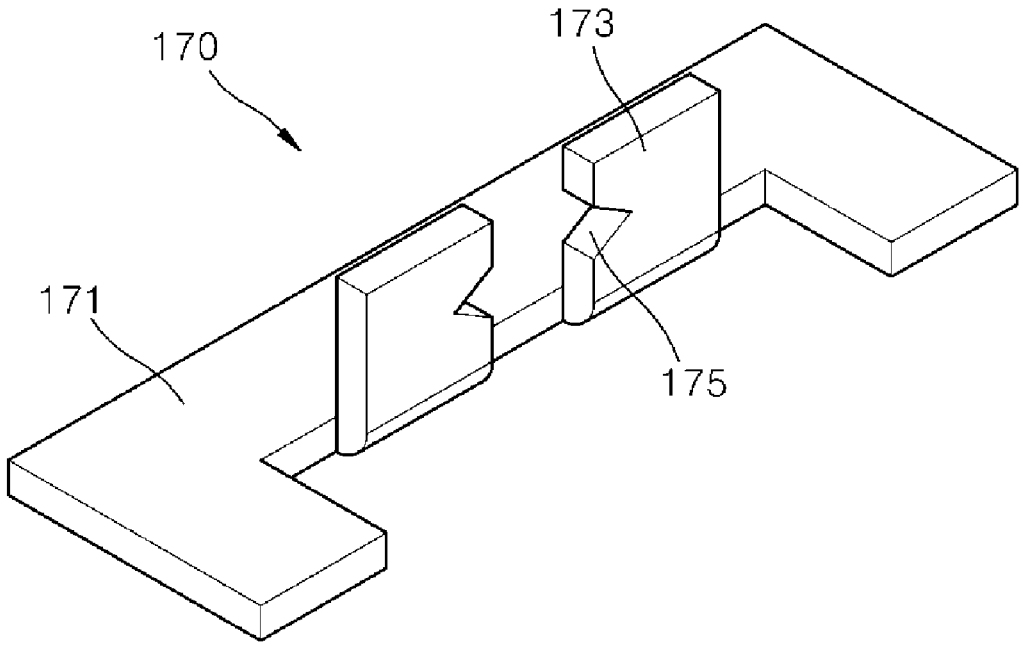
FIG. 12 is a perspective view illustrating a tail shown in FIG. 1.

FIG. 12 is a perspective view illustrating the tail 170. Referring to FIG. 12 the tail 170 is formed of a single body including the bottom panel 171 disposed opposite to the signal transmission panel 113 interposing the body 130 therebetween, the bottom panel 171 on which the bottom surface of the dielectric 150 is put to support the dielectric 150 and one or more vertical panels 173 formed to be parallel to the bottom panel 171 and inserted into the dielectric 150 in such a way that the bottom panel 171 is not separated from the dielectric 150.

In detail, the bottom panel 171 is in the shape of ⊏, the vertical panel 173 is formed in the center of the bottom panel 171 to be vertical thereto, and a tail fastening part 175 is formed on a side of the vertical panel 173 in such a way that the vertical panel 173 is not easily separated from the dielectric 150. Referring to FIG. 12, the tail fastening part 175 may be a groove formed on one side of the vertical panel 173. The groove formed on the one side of the vertical panel 173 functions as the tail fastening part 175 in such a way that the vertical panel 173 is not easily separated from the dielectric 150.

Figure 13:
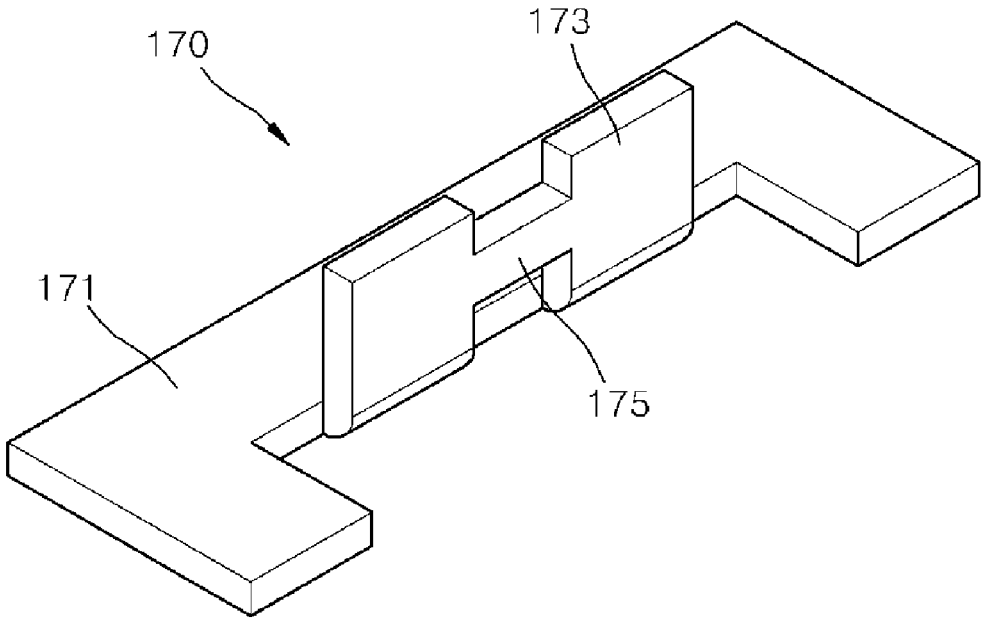
FIG. 13 is a perspective view illustrating another configuration of the tail of FIG. 12.
Figure 14:
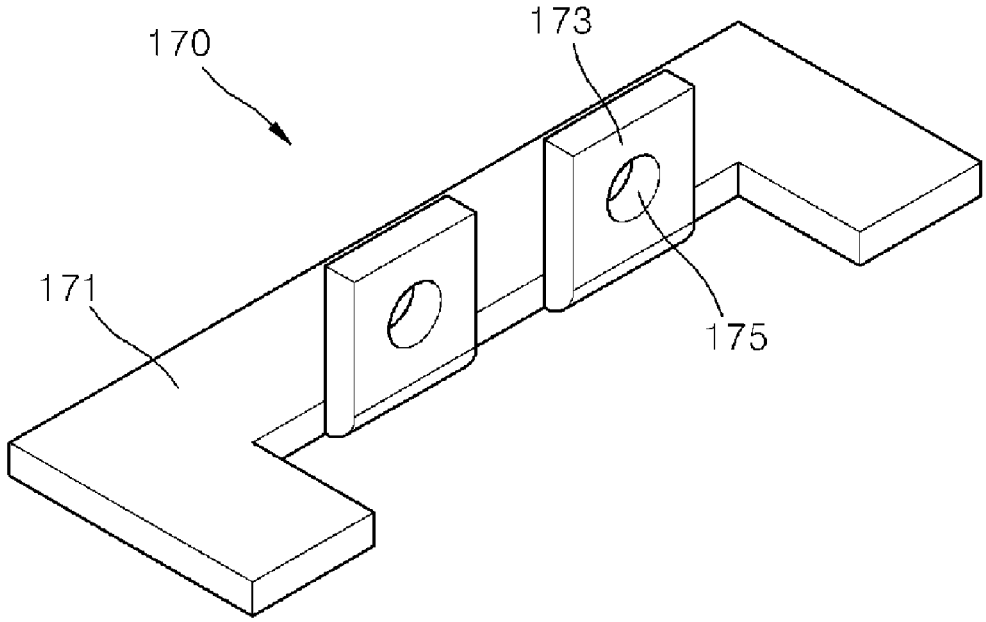
FIG. 14 is a perspective view illustrating still another configuration of the tail of FIG. 12.

FIG. 13 is a perspective view illustrating another example of a configuration of the tail 170. FIG. 14 is a perspective view illustrating still another example of the configuration of the tail 170. The tail fastening part 175 may be in various shapes and not limited to the groove shown in FIG. 12. In FIGS. 13 and 14, there are shown various examples of the shape of the tail fastening part 175. That is, the tail fastening part 175 may be a beam connecting one or more vertical panels 173 to one another as shown in FIG. 13. The beam is inserted together with the vertical panels 173 to prevent that the vertical panels 173 are easily separated from the dielectric 150 downward. Also, the tail fastening part 175 may be a hole formed on the vertical panel 173 as shown in FIG. 14. Since the dielectric 150 is inserted into the hole and hardened when the vertical panel 173 is inserted into the dielectric 150, the vertical panel 173 is prevented from being taken off.

In addition to the shapes shown in FIGS. 12 to 14, the tail fastening part 175 may be formed in various shapes. Also, the vertical panel 173 may have a T-shape of its own to prevent separation from the dielectric 150. As described above, since the configurations of the tail fastening part 175 and the vertical panel 173 to prevent that the vertical panel 173 is easily separated from the dielectric 150 may be well understood by those skilled in the art, additional description will be omitted.

Figure 15:
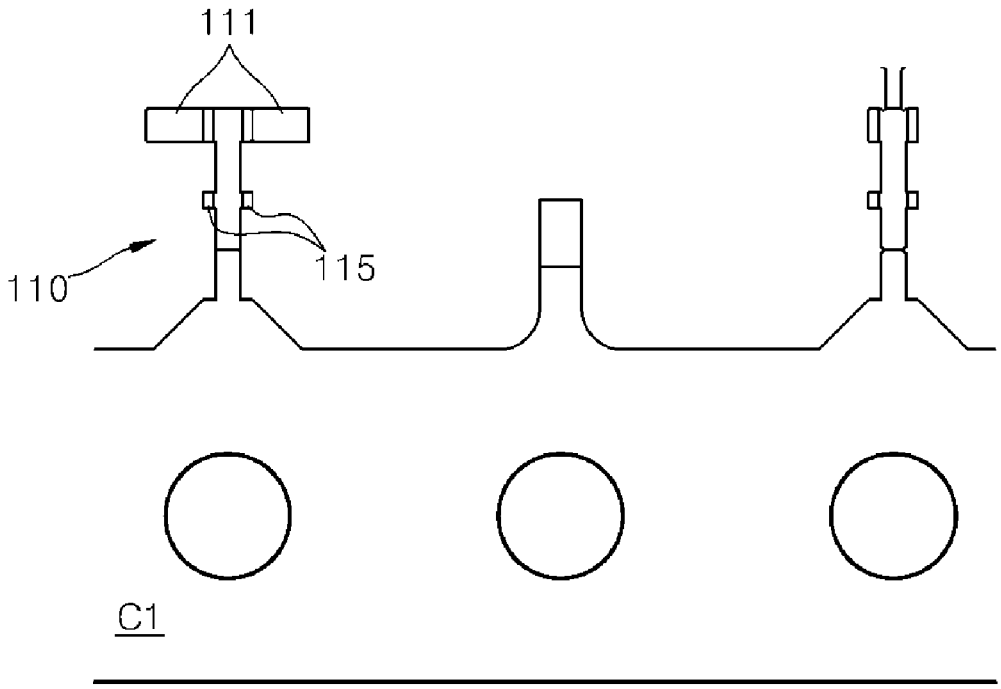
Figure 16:
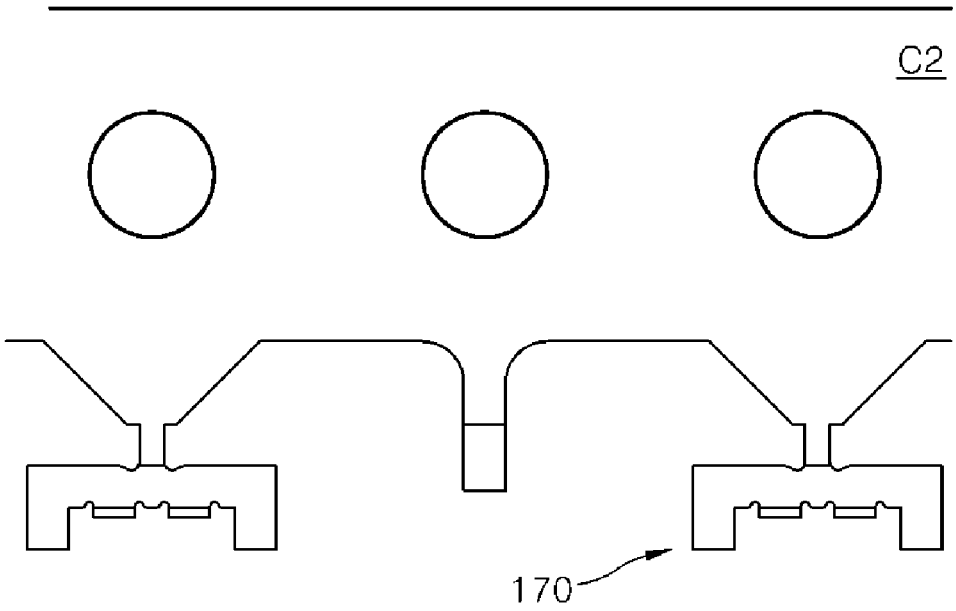
FIG. 16 is a view illustrating a process of manufacturing the tail of FIG. 12.
Figure 17:
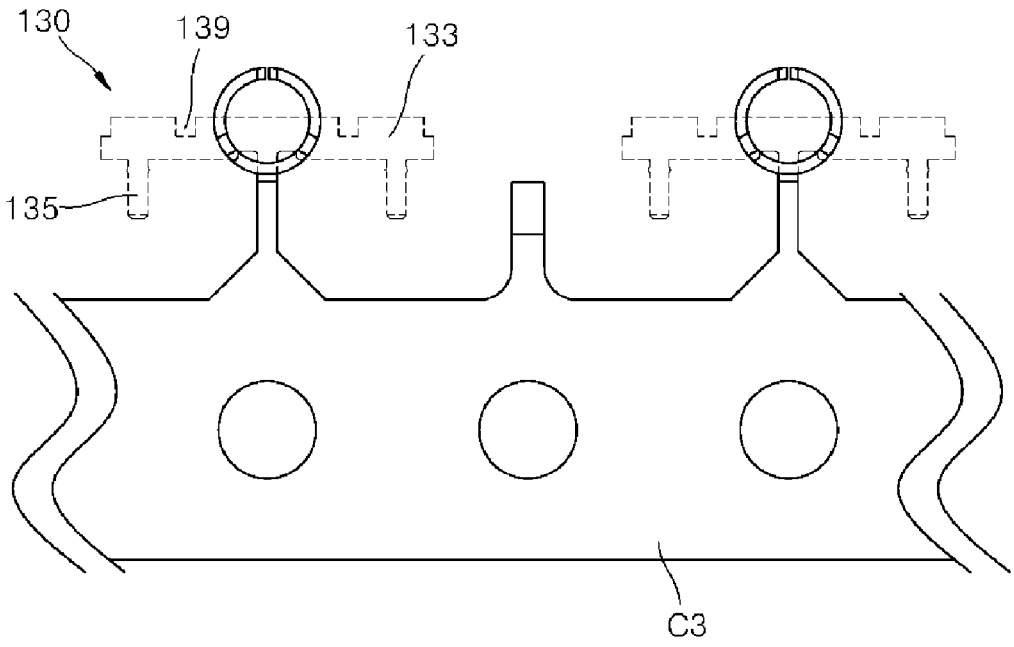
FIG. 17 is a view illustrating a process of manufacturing the body of FIG. 5.

FIG. 15 is a view illustrating a process of manufacturing the conductor 110. FIG. 16 is a view illustrating a process of manufacturing the tail 170. FIG. 17 is a view illustrating a process of manufacturing the body 130. Referring to FIG. 15, the core conductors 110 are disposed on a carrier C1 at regular intervals. The carrier C1 and the core conductors 110 shown in FIG. 15 may be mass-produced by automation facilities. Referring to FIG. 16, the tails 170 are disposed on a carrier C2 at regular intervals. Similarly, the tails 170 and the carrier C2 may be mass-produced by automation facilities.

Referring to FIG. 17, the bodies 130 are disposed on a carrier C3 at regular intervals and the bodies 130 and the carrier C3 may be mass-produced by automation facilities. The body 130 shown in FIG. 17 is spread while connected to the carrier C3 but rolled in a circular shape in such a way that both ends are in contact with each other to form one body 130. Particularly, the both ends are not completely coupled with each other and there is generated a gap, which functions as the incision part 131. As described above, the core conductor 110, the body 130, the dielectric 150, and the tail 170 are separately manufactured, respectively, and assembled, thereby form on connector. In this case, since several sets of respective elements may be assembled at one time while connected to the carriers C1, C2, and C3, productivity of the connector 100 may be increased. Also, the core conductor 110 and the tail 170 are coupled with the dielectric 150 by insert molding and the body 130 is inserted into the dielectric 150, thereby forming the connector 100.

Figure 18:
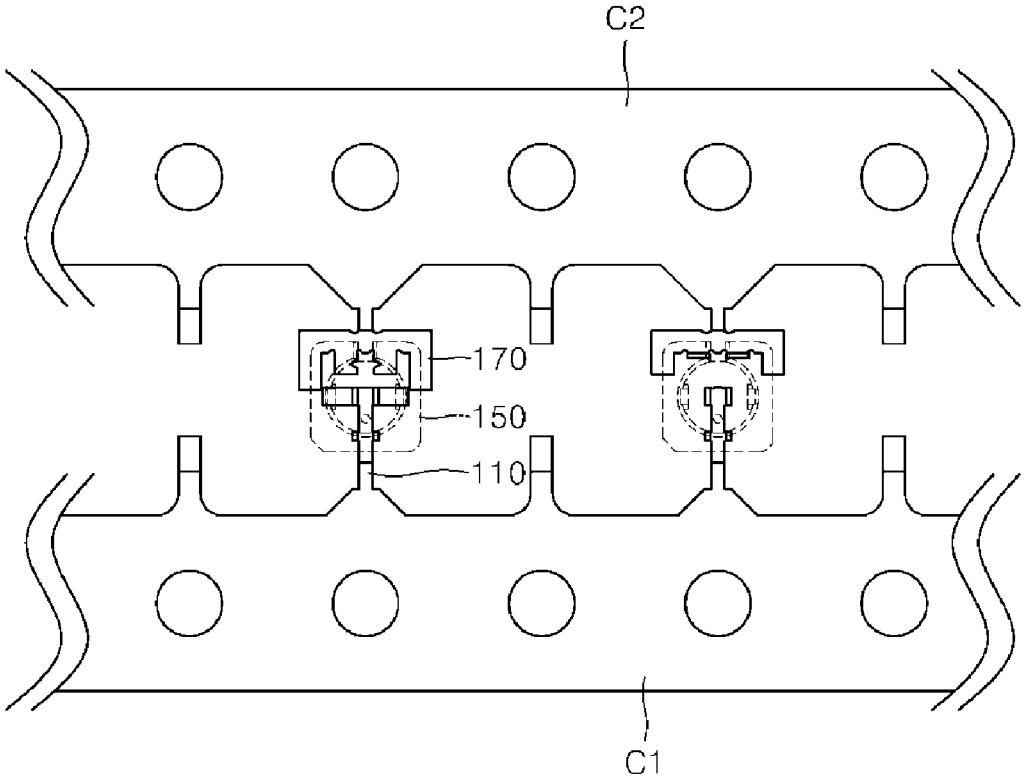
FIG. 18 is a view illustrating a view of coupling the core conductor coupled with the tail with the dielectric by insert molding.

FIG. 18 is a view illustrating a process of coupling the core conductor 110 disposed together with the tail 170 with the dielectric 150 by insert molding. Referring to FIG. 18, the core conductors 110 connected to the carrier C1 and the tails 170 connected to the carrier C2 are suitably disposed close to one another, a mold for forming the dielectric 150 is disposed thereupon, and the dielectric 150 is formed by insert molding simultaneously with coupling the core conductor 110 with the dielectric 150. When the tail 170, the core conductor 110, and the dielectric 150 are coupled with one another, the body 130 is inserted into the ring-shaped insertion hole 151 of the dielectric 150 to be coupled therewith, thereby forming the connector 100. Accordingly, different from conventional methods, since the body 130 is separately manufactured and inserted into the dielectric 150, possible damage of a core while a mold, the core, is inserted into and extract from the body 130 is perfectly removed and coupling force may be more increased by adjusting a size and a depth of a fastening groove to make the body 130 suitable for a corresponding plug.

INDUSTRIAL APPLICABILITY

This invention can be used in the field of manufacturing of a connector.

The invention claimed is:

1. A connector comprising:

a core conductor comprising a contact terminal formed of two or more insertion panels forming an insertion space into which a signal pin is inserted and a signal transmission panel connected to a bottom of the contact terminal and electrically connected to an external signal line;

a body comprising a trunk formed in the shape of a barrel surrounding the contact terminal, the trunk comprising an incision part electrically insulated from the core conductor, wherein the incision part provides a space for expanding and contracting while coupling with a plug, and one or more projection arms extended from a bottom of the trunk;

a dielectric holding the contact terminal and the bottom of the trunk of the body; and a tail comprising a bottom panel disposed opposite to the signal transmission panel and supporting the dielectric, the bottom panel on which a bottom of the dielectric is put, and one or more vertical panels formed vertical to the bottom panel and inserted into the dielectric in such a way that the bottom panel is not separated from the dielectric.

2. The connector of claim 1, wherein a vertical part is inserted into the dielectric in such a way that the contact terminal held by the dielectric is not easily separated, wherein the vertical part is formed on the signal transmission panel in a single body to be vertical to the signal transmission panel.

3. The connector of claim 1, wherein a fastening groove preventing separation of the plug after coupling is further formed around an upper circumference of the trunk;

one or more fastening projections preventing the separation of the plug are formed along an inner circumference of the trunk; and one or more coupling support grooves are formed on a top of the body.

4. The connector of claim 1, wherein two projection arms are extended from both ends of the bottom of the trunk, which are parallel to each other, and while the projection arms and the bottom of the trunk are held by the dielectric, the projection arms passing through the dielectric are projected from a bottom surface of the dielectric and are bent toward both sides of the dielectric in such a way that the trunk is not easily separated from the dielectric.

5. The connector of claim 1, wherein the bottom panel is in the shape of ⊏;

the vertical panel is formed in the center of the bottom surface to be vertical thereto; and a tail fastening part is formed on a side of the vertical panel in such a way that the vertical panel is not easily separated from the dielectric.

6. The connector of claim 5, wherein the tail fastening part is a groove formed on the side of the vertical panel.

7. The connector of claim 5, wherein the tail fastening part is in the shape of a beam connecting the one or more vertical panels with one another.

8. The connector of claim 5, wherein the tail fastening part is a hole formed on the vertical panel.

9. The connector of claim 1, wherein the core conductor, the body, the dielectric, and the tail are manufactured separately, and assembled.

10. The connector of claim 1, wherein the core conductor and the tail are coupled with the dielectric by insert molding and the body is inserted into the dielectric.

11. The connector of claim 1, wherein the dielectric is a body holding part formed of a tetrahedral mold and comprises:

a ring-shaped insertion hole into which the bottom of the trunk is inserted and held in a center thereof, a projection arm guide hole, into which the projection arm is inserted, formed on both sides of the ring-shaped hole, and insertion panel holes, into which the insertion panel is inserted, formed on the center of the ring-shaped hole, and wherein a projection arm location part is formed on the bottom surface of the dielectric where the projection arm projected via the projection arm guide hole is bent and in contact with, a signal transmission panel location part where the signal transmission panel connected to the insertion panels inserted into the insertion panel holes is in contact with, a bottom panel location part where the bottom panel is in contact with, and wherein vertical panel holes, into which the vertical panel is inserted, are formed on the bottom surface of the dielectric.

* * * * *

UNITED STATES PATENT AND TRADEMARK OFFICE

CERTIFICATE OF CORRECTION

PATENT NO. : 8,333,596 B2
APPLICATION NO. : 13/256582
DATED : December 18, 2012
INVENTOR(S) : Kyoung il Kang et al.

It is certified that error appears in the above-identified patent and that said Letters Patent is hereby corrected as shown below:

(1) Column 3, line 39, insert the following paragraph: --FIG. 15 is a view illustrating a process of manufacturing the core conductor of FIG. 4;--

(2) Column 7, line 39, insert the following paragraph: --As described above, exemplary embodiments have been shown and described. Though specific terms are used herein, they are just used for describing the present invention but do not limit the meanings and the scope of the present invention disclosed in the claims. Therefore, it would be appreciated by those skilled in the art that changes may be made to these embodiments without departing from the principles and spirit of the invention. Accordingly, the technical scope of the present invention is defined by the claims and their equivalents.--

Signed and Sealed this
Ninth Day of April, 2013

Teresa Stanek Rea
*Acting Director of the United States Patent and Trademark Office*